US005519940A

United States Patent [19]

Brondfield

[11] Patent Number: 5,519,940

[45] Date of Patent: May 28, 1996

[54] MULTI-COMPONENT STENCIL

[76] Inventor: Gary Brondfield, 26500 Hendon Rd., Beachwood, Ohio 44122

[21] Appl. No.: 350,950

[22] Filed: Dec. 7, 1994

[51] Int. Cl.[6] ..... B43L 13/20

[52] U.S. Cl. ..... 33/1 G; 33/563; 33/565

[58] Field of Search ..... 33/1 G, 562, 563, 33/565, 566, 392; 273/31, 1.5 R, 25

[56] References Cited

U.S. PATENT DOCUMENTS

| | | | |
|---|---|---|---|
| 1,986,941 | 1/1935 | Pearson | 273/31 |
| 3,448,525 | 6/1969 | Majewski | 33/392 |
| 4,088,317 | 5/1978 | Gierla | 273/31 |
| 4,125,658 | 11/1978 | Miles | 33/563 |
| 4,712,309 | 12/1987 | Kingston et al. | 33/562 |
| 4,937,949 | 7/1990 | Kiefer | 33/563 |
| 5,333,389 | 8/1994 | Carroll | 33/430 |

*Primary Examiner*—Christopher W. Fulton
*Attorney, Agent, or Firm*—D. Peter Hochberg; Mark Ksuner; Michael Jaffe

[57] ABSTRACT

A device for defining the profile of a basketball foul lane and key on a surface such as asphalt or concrete. The device is comprised of a plurality of panels wherein each panel has opposing side walls which define a section of the profile therebetween. Connecting ribs are disposed between the side walls for the purpose of connecting the side walls. The plurality of panels is arrangeable so that the sections of the profile align to form the profile of a basketball foul lane and key. The device may be conveniently supplied and sold as an apparatus which includes the device, tape to temporarily attach the device to the solid surface, paint to paint the profile exposed on the surface by the device and a plumb bob to properly align the device on the surface.

19 Claims, 3 Drawing Sheets

MULTI-COMPONENT STENCIL

FIELD OF THE INVENTION

This invention relates generally to a device for defining a profile of a game court to be painted on a solid surface. More particularly, the invention relates to a plurality of arrangeable panels which are dimensioned such that they can be assembled into a mask or stencil defining the profile of a basketball foul lane and key whereby the profile can then be painted on a solid surface such as concrete or asphalt.

BACKGROUND OF THE INVENTION

Basketball has long been a popular sport in the United States. Children begin playing at an early age and the sport is a standard activity in physical education classes. Organized leagues abound throughout the United States for both sexes and for all ages. Lately, a number of "over 30" or "over 40" leagues have formed as people's love of the game, developed at an early age, continues throughout one's life. The sport is played competitively at the high school, collegiate and professional level.

Many homeowners erect basketball backboards and rims or hoops in their backyard or driveway so that they and/or their children can play basketball without having to go to a gym. Generally no lines defining the foul lane or key are painted on the driveway pavement because of the inconvenience and expense, and because sloppy work would be aesthetically unpleasing to many property owners. Such lines are important, however, in order to give players perspective of the court's dimensions. Additionally, the foul lane defines the area in which a three-second violation may be called and the foul line is where one stands to shoot free throws.

The method normally used for painting lines on a blacktop, asphalt or concrete surface is to first outline the profile to be painted and then paint over the outlined profile. The profile is outlined by using a tape or string to measure the distances, while referring to a diagram showing the proper dimensions, and using a chalk or string to mark the profile on the surface to be painted. A line is then painted along the profile by a hand-operated paint striping machine or a "marking wand," which is a long metal pole with a single wheel affixed to one end and a support member for holding a can of paint. The striping machine or marking wand is pushed, or if self-driven, directed, by an operator who walks behind the machine following the outline. In this manner, a painted stripe is applied to the surface. This method is inconvenient and expensive, and generally is only done by schools and recreational institutions. Either the home owner or a professional painter must first research the proper dimensions of the basketball foul lane and key, and then measure and outline the profile onto the surface to be painted. Another option is to painstakingly trace the profile of the foul lane and key onto sheets of paper and cardboard, cut out a stencil, then affix the stencil to the surface to be painted and paint the profile defined by the stencil. The lines are then painted along the profile defined by the stencil.

The present invention overcomes the difficulty and expense of painting the profile of a foul lane and key by providing a device comprised of a preformed stencil apparatus which is easy to assemble and inexpensive to manufacture.

SUMMARY OF THE INVENTION

In accordance with the present invention, there is provided a device for defining the profile of a basketball foul lane and key. The device is comprised of a plurality of individual panels including curved panels, linear panels and transition panels. Each panel has two opposing side walls defining a section of the profile therebetween. Connecting ribs, which connect the side walls, are disposed between the side walls. The panels are arrangeable such that the sections of the profile defined between the side walls of each panel align to form the profile of a basketball foul lane and key. The device is assembled on top of a solid surface, such as asphalt or concrete, and paint is applied to the portion of the solid surface exposed through the profile defined by the device. Thus, the profile of a basketball foul lane and key is painted onto the solid surface.

In accordance with another aspect of the present invention there is provided apparatus containing: (a) the device for defining the profile according to the present invention, (b) securing means for temporarily securing the device to a surface to be painted, (c) paint for painting the section of the surface exposed by the profile, and (d) a plumb bob designed to be suspended between a backboard and the surface to be painted in order to properly align the device on the surface to be painted.

It is an object of the present invention to provide a device which defines the profile of a basketball foul lane and key for the purpose of painting the profile on a solid surface.

Another object of the invention is to provide a device as described above which is easy to assemble and easy to attach to a surface to be painted.

Another object of the present invention is to provide a device as described above having a plurality of conveniently sized panels whereby each panel contains a section of the profile of a basketball foul lane and key wherein the panels are arrangeable so that the sections of the profile align to form the profile of a basketball foul lane and key.

Another object of the present invention is- to provide a device as described above having linear panels, curved panels, and two-way transition panels and three-way transition panels wherein the linear panels are equally dimensioned, the curved panels are equally dimensioned, the two-way transition panels are equally dimensioned and the three-way transition panels are equally dimensioned.

Another object of the present invention is to provide a device as described above wherein the linear panels, curved panels and transition panels are all of the same width.

Another object of the present invention is to provide a device as described above having panels produced of paper or cardboard.

These and other objects and advantages will become apparent from the following description of a preferred embodiment of the invention taken together with the accompanying drawings.

BRIEF DESCRIPTION OF THE DRAWINGS

The invention may take physical form in certain parts and arrangements of parts, an embodiment of which is described in detail in the specification and illustrated in the accompanying drawings wherein.

DETAILED DESCRIPTION OF THE INVENTION

Figure 1:
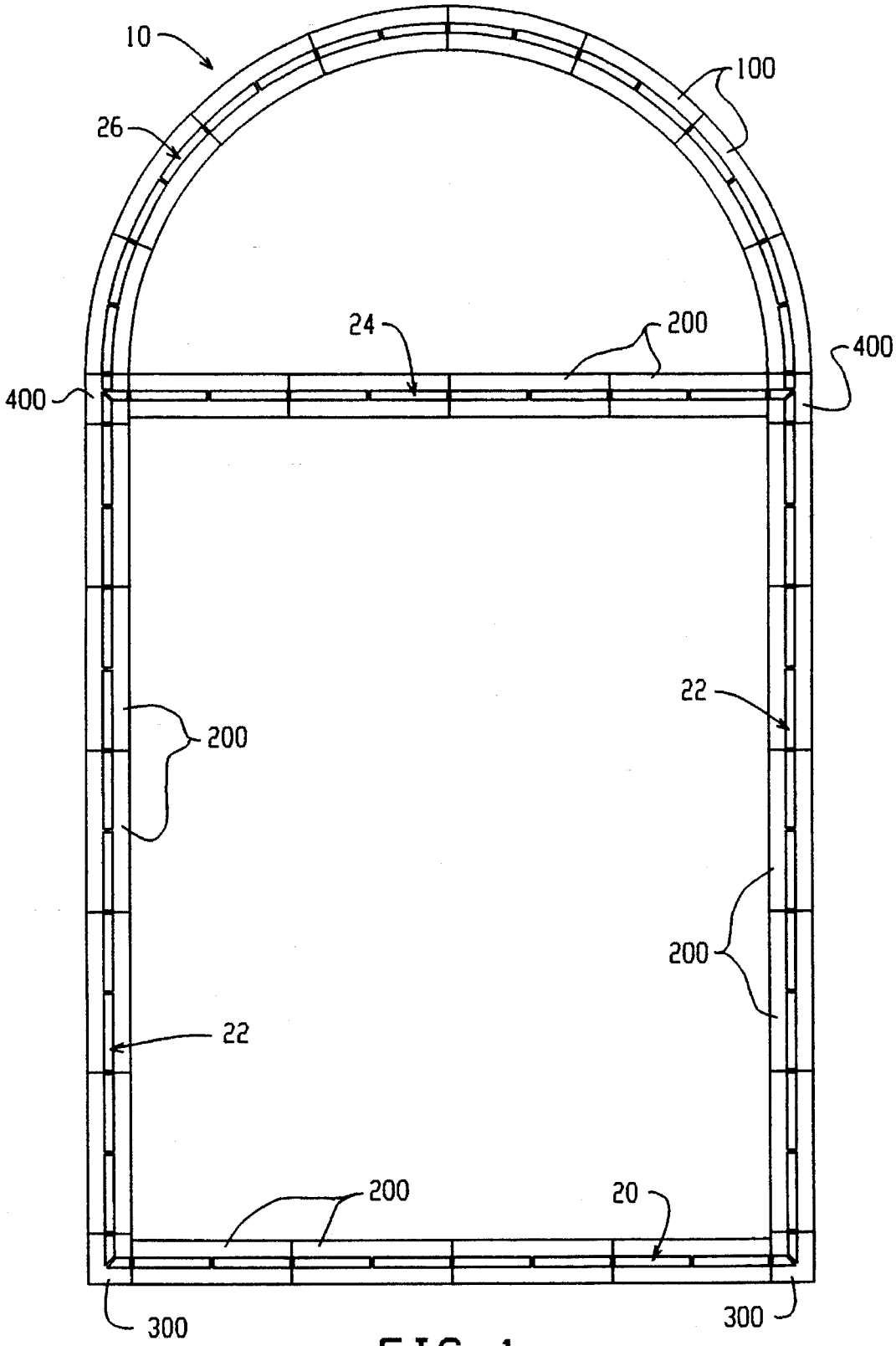
FIG. 1 is a top view of the present invention which includes a plurality of panels arranged to form a discontinuous aperture defining the profile of a basketball foul lane and key.

Referring now to the drawings which are for the purpose of illustrating the preferred embodiment of the invention only, and not for the purpose of limiting same, FIG. 1 shows a device 10 according to the present invention which defines the shape of a basketball foul lane and key.

Figure 2:
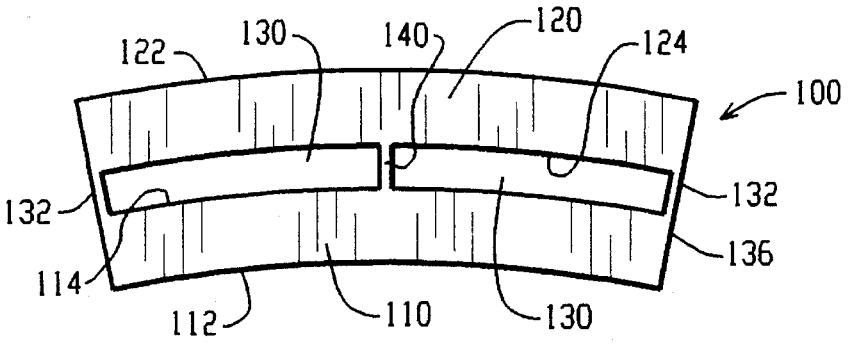
FIG. 2 is a top view of a curved panel in accordance with the present device.

In the embodiment shown, device 10 is comprised of a plurality of flat, foldable panels. In the preferred embodiment the foldable panels consist of eight curved panels 100, eighteen linear panels 200, two two-way transition panels 300 and two three-way transition panels 400. Preferably panels 100, 200, 300 and 400 are of the same width, which in a preferred embodiment is 9", as this expedites alignment of the apertures as will be discussed in greater detail below. The panels are preferably formed from pressed cardboard diecut into the specific shape of each panel. Other appropriate materials include paper, plastic or thin strips of metal or wood. As shown in FIG. 2, each curved panel 100 has an annular inner surface 110 and an annular outer surface 120 which define annular aperture section 130 therebetween. In a preferred embodiment inner surface 110 and outer surface 120 have the same width. Inner surface 110 has an exterior edge 112 and an interior edge 114 whereby interior edge 114 also forms the inner annular edge of aperture 130. Outer surface 120 has an exterior edge 122 and an interior edge 124 whereby interior edge 124 forms the outer annular edge of aperture 130. Lateral edges 132 are linear and perpendicular to the arc defined by panel 100. External ribs 136 are disposed at opposing lateral ends of panel 100 and connect inner surface 110 and outer surface 120. Internal rib 140 connects inner surface 110 to outer surface 120 and is disposed approximately midway between external ribs 136 thereby bisecting aperture 130. In the embodiment shown, each curved panel 100 has the same arc and therefore can be arranged to form a key section having a smooth, continuous are.

Figure 3:
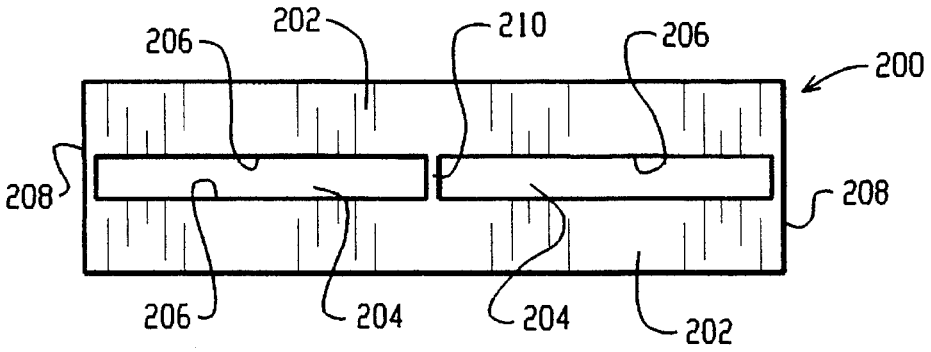
FIG. 3 is a top view of a linear panel in accordance with the present invention.

As shown in FIG. 3, each linear panel 200 has two opposing longitudinal surfaces 202 defining a linear aperture 204 therebetween. Opposing surfaces 202 are preferably the same width so that panel 200 is reversible. Each surface 202 includes an internal longitudinal edge 206 which also form the respective outer longitudinal edges of linear aperture 204. Two opposing connecting ribs 208 are formed at the distal ends of panel 200. Ribs 208 are perpendicular to, and connect, opposing surfaces 202. Internal rib 210 connects opposing surfaces 202 and is located approximately midway between connecting ribs 208 thus bisecting aperture 204 into two equally dimensioned sections. In the embodiment shown panel 200 has a width of 9" and a length of 33¼".

Figure 4:
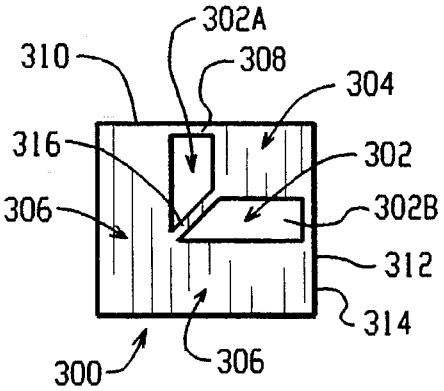
FIG. 4 is a top view of a two-way transition panel in accordance the present invention.

Turning now to FIG. 4, two-way transition panel 300 is shown. Panel 300 is rectangular and has an aperture 302 formed therein. Aperture 302 has two generally linear portions 302A and 302B, which are formed perpendicular to one another and form a right angle within panel 300. Panel 300 has a surface 304 formed on one side of aperture 302 and a surface 306 formed on the other side of aperture 302. Connecting rib 308 is formed along an exterior edge 310 of panel 300 and connects surface 304 to surface 306. Connecting rib 312 is formed along an exterior edge 314 of panel 300 wherein edge 314 is perpendicular to edge 310. Connecting rib 312 connects surface 304 to surface 306. Internal rib 316 extends diagonally between aperture portions 302A and 302B and connects surface 304 to surface 306.

Figure 5:
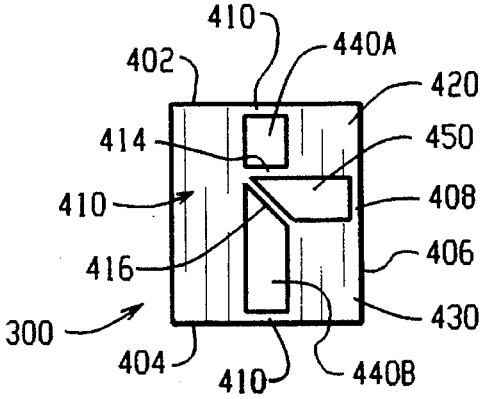
FIG. 5 is a top view of a three-way transition panel in accordance with the present invention.

Turning now to FIG. 5, three-way corner panel 400 is best seen. Panel 400 is rectangular and contains a longitudinal surface 410 which opposes a small rectangular surface 420 and a large rectangular surface 430 thus defining apertures 440A and 440B therebetween. Apertures 440A and 440B are generally linear and are axially aligned. A generally linear aperture 450, which is perpendicular to apertures 440A and 440B, is disposed between rectangular surfaces 420 and 430.

Aperture 440A extends from an exterior edge 402 of panel 400 to a connecting rib 414. Connecting rib 414 is formed along one lateral side of aperture 440A, and connects surfaces 410 and 420. Aperture 440B extends from an edge 404 of panel 400, which opposes and is generally parallel to edge 402, to connecting rib 416. Rib 416 extends diagonally between apertures 450 and 440B and connects surfaces 410 and 430. Aperture 450 extends from an edge 406 of panel 400 to connecting rib 416. Edge 406 is perpendicular to edges 402 and 404. Connecting rib 408 connects surfaces 420 and 430, is formed along edge 406, and connecting rib 411 is formed along edge 404 and connects surfaces 410 and 430. Connecting rib 412 is formed along edge 402 and connects surfaces 410 and 420.

Turning now to the assembly of device 10, it will be appreciated that the easier the plurality of panels are to assemble the greater the utility to the user and the greater the market success of the product. In this respect, the panels have been designed to have the same width, preferably 9". This configuration enables the aperture sections to be aligned simply by aligning the outer edges of the panels. Further, the aperture section contained within each curved panel 100 and each linear panel 200 is centered within the panel to create equally dimensioned sidewalls thereby making the linear panels reversible and making the overall alignment easier.

The panels 100, 200, 300 and 400 of device 10 are assembled on a surface to be painted to create the profile as shown in FIG. 1. Four linear panels 200 are aligned to form a baseline profile 20. The two two-way transition panels 300 are placed at opposing ends, respectively, of the baseline profile 20 formed by the linear panels 200 and create a transition to sidelines 22 of the foul lane. Importantly, the edges 314 of the two-way transition panels 300 align with the panels 200 which form the baseline 20.

The two respective sidelines 22 of the foul lane are defined by aligning five linear panels 200 with edges 310 of each two-way transition panel 300.

Three-way transition panels 400 are aligned with the respective sidelines 22 at the ends opposite two-way transition panels 300 to define a transition to a foul line 24 and to a key 26. Importantly, three-way transition panels 400 are arranged so that edges 404 are aligned with the linear panels 200 forming the respective sidelines 22 of the foul lane. Apertures 440A at edges 402 define the transition to the key 26 and apertures 450 at edges 406 define the transition to the foul line 24.

The foul line 24 is then defined by aligning four linear panels 200 between the respective edges 406 of transition panels 400.

Figure 6:
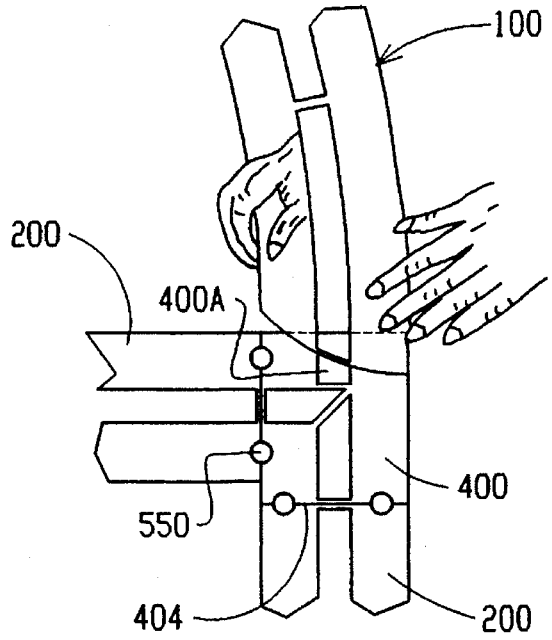
FIG. 6 is a perspective view of panels of the invention being installed.

The key 26 is defined by aligning the eight curved panels 100 with each other to form a continuous arc. The lower panel 100 on either side of the arc overlaps respective edges 402 of transition panels 404 thereby forming a semicircle above the foul line 24, as shown in FIG. 1. The placement of curved panel 100 on transition panel 400 is shown in FIG. 6. Adjacent panels are conveniently adhered together by adhesive dots, discussed below.

The plurality of panels, which are now aligned so that they define an aperture having the profile of a basketball foul lane and key, are secured into place using adhesives, such as tape, or weights. At this point, paint is applied to the surface exposed by the aperture, thus painting the profile of a basketball foul lane and key, including a foul line and baseline, on the surface. The opposing surfaces of the panels heretofore described form a mask to keep spills and drips off of the surface to be painted. After the painting has been completed, the stencils should be removed from the surface and discarded.

Figure 7:
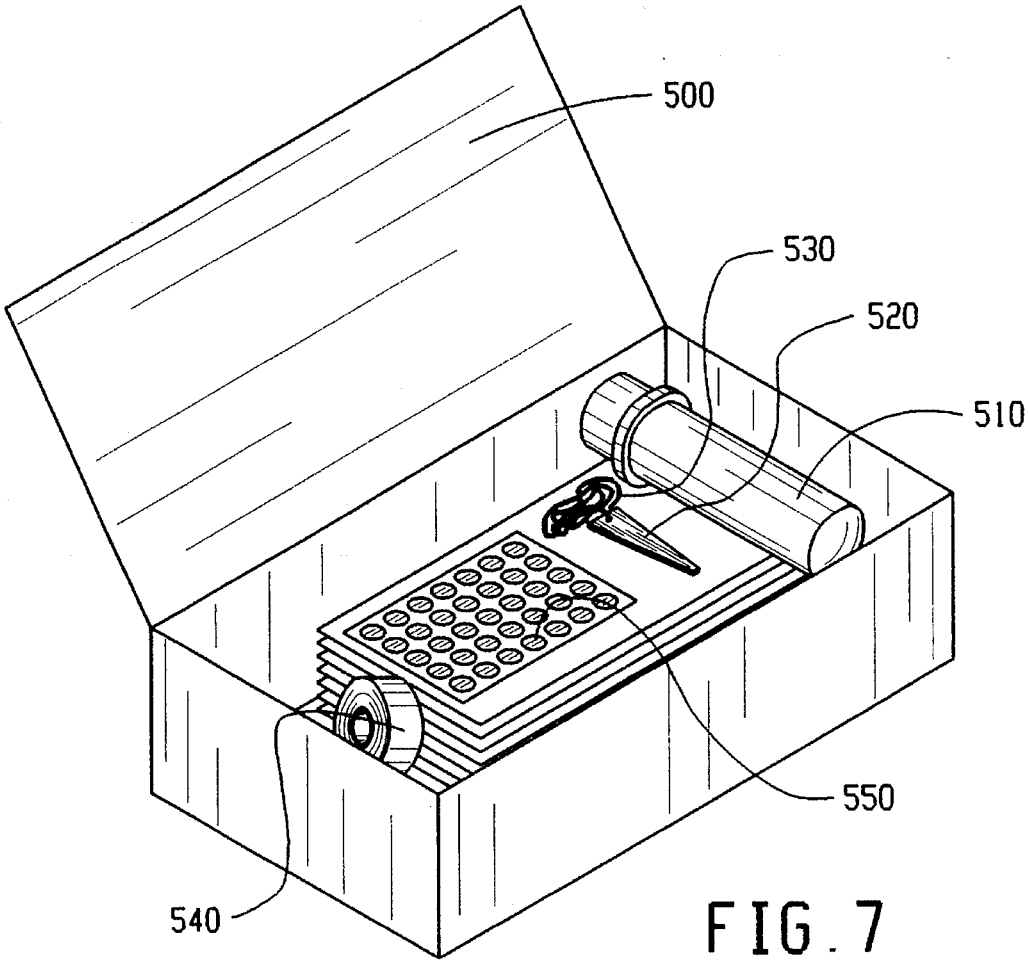
FIG. 7 is a container for components of the invention.

Preferably, the multi-component stencil herein described is sold as a kit. Referring to FIG. 7, the kit is contained in a suitable package, preferably a cardboard box 500, and includes a can of spray paint 510, a plumb-bob 520 on a string 530 for aligning the baseline with the plane defined by the backboard, and securing means, which is preferably adhesive strips or a roll of adhesive tape shown by the numeral 540, for attaching the panels to the ground. Panels can be secured together by means of adhesive dots 550, which usually are supplied on paper support strips.

The invention has been described in detail with particular emphasis on the preferred embodiments but variations within the spirit and scope of the invention may occur to those skilled in the art.

What is claimed is:

1. A device for defining the profile of a basketball foul lane and key, said profile including the foul line, baseline, two foul lane lines, and key, said device being mountable on a horizontal base surface made of a solid material such as concrete or asphalt, said device comprising:

a plurality of stencil means for defining part of said profile, each of said stencil means being individually separable flat planar panels, having two opposing side walls and connecting means interposed between said side walls for connecting said side walls, said side walls defining an aperture section therebetween, said plurality of stencil means arrangeable so that said aperture sections align to form a profile having the shape of a basketball foul lane and key.

2. A device as defined in claim 1 wherein said stencil means are formed from paperboard.

3. A device as defined in claim 1 wherein said plurality of stencil means includes at least two annular panels for defining said key, and at least two linear panels for defining other parts of said profile.

4. A device as defined in claim 3 wherein said linear panels are equally dimensioned and said annular panels are equally dimensioned.

5. A device as defined in claim 4 wherein said linear panels and said curved panels are the same width.

6. A device as defined in claim 1 wherein said plurality of stencil means is comprised of:

a plurality of two-way transition panels for defining corners of said key;

a plurality of three-way transition panels for defining the intersection of said foul lane, the key and sides of said foul lane;

a plurality of curved panels for defining said key; and a plurality of straight panels for defining straight lines of said profile.

7. A device as defined in claim 6 wherein said two-way transition panels are equally dimensioned.

8. A device as defined in claim 6 wherein said three-way transition panels are equally dimensioned.

9. A device as defined in claim 6 wherein said plurality of stencil means is comprised of:

two two-way transition panels, two three-way transition panels, eight curved panels, and eighteen straight panels;

wherein each of said panels contains an aperture section, said stencil means being positionable to form said profile wherein the aperture sections in said curved panels define the key, the aperture sections in the linear panels define the baseline, foul line and two foul lane lines, the aperture sections in the three-way transition sections form corners connecting the foul line to each respective foul lane line and form transition lines connecting each respective foul lane line to the key, and aperture sections in the two-way transition sections form corners connecting the baseline to each respective foul lane line.

10. A device as defined in claim 6 wherein said linear panels, said curved panels, said two-way transition panels and said three-way transition panels are the same width.

11. An apparatus defining the shape of a basketball foul lane and key, said apparatus mountable on a hard court surface, said apparatus comprising:

(a) a plurality of stencil means for defining part of said profile, each of said stencil means being individually separable, and having two opposing side walls and connecting means interposed between said side walls for connecting said side walls, said side walls defining an aperture section therebetween, said plurality of stencil means arrangeable so that said aperture sections align to form a profile having the shape of a basketball foul lane and key, (b) paint suitable for application to the surface to be painted, (c) securing means for securing said plurality of stencil means to said surface, (d) a plumb-bob consisting of a weight fastened to a string, said string having a free end which is attachable to a backboard and a second end fastened to said weight whereby said weight drops to the surface beneath the backboard when said free end is fastened to said backboard to indicate where the baseline should be positioned, (e) a package container suitable for holding a plurality of stencil means for defining part of said profile, each of said stencil means having two opposing side walls and connecting means interposed between said side walls for connecting said side walls, said side walls defining an aperture section therebetween, said plurality of stencil means arrangeable so that said aperture sections align to form a profile having the shape of a basketball foul lane and key, paint suitable for application to the solid surface to be painted and securing means for securing said plurality of stencil means to said solid surface, and a plum-bob consisting of a weight-fastened to a string, said string having a free end which is attachable to a backboard and a second end fastened to said weight whereby said weight drops to the surface beneath the backboard when said free end is fastened to said backboard to indicate where the baseline should be positioned.

12. An apparatus as defined in claim 11 wherein said securing means comprises a roll of adhesive tape and precut adhesive elements.

13. An apparatus as defined in claim 11 wherein said plurality of stencil means includes at least two curved panels and two linear panels.

14. An apparatus as defined in claim 13 wherein said linear panels are equally dimensioned and said curved panels are equally dimensioned.

15. An apparatus as defined in claim 13 wherein said curved panels and said linear panels are the same width.

16. An apparatus as defined in claim 11 wherein said plurality of stencil means is comprised of:

a plurality of two-way transition panels for defining corners of said key;

a plurality of three-way transition panels for defining the intersection of said foul lane, the key and sides of said foul lane;

a plurality of curved panels for defining said key; and a plurality of straight panels for defining straight lines of said profile.

17. An apparatus as defined in claim 16 wherein said two-way transition elements are equally dimensioned and said three-way transition elements are equally dimensioned.

18. An apparatus as defined in claim 16 wherein said linear panels, said curved panels, said two-way transition panels and said three-way transition panels are the same width.

19. An apparatus as defined in claim 11 wherein said plurality of stencil means is comprised of:

two two-way transition panels, two three-way transition panels, eight curved panels, and eighteen straight panels, wherein each of said panels contains a stencil section wherein when said stencil means being positionable to form said profile wherein the aperture sections in said curved panels define the key, the aperture sections in the linear panels define the baseline, foul line and two foul lane lines, the aperture sections in the three-way transition sections form corners connecting the foul line to each respective foul lane line and form transition lines connecting each respective foul lane line to the key, and aperture sections in the two-way transition sections form corners connecting the baseline to each respective foul lane line.

* * * * *